US009429348B2

(12) United States Patent
Breiling et al.

(10) Patent No.: US 9,429,348 B2
(45) Date of Patent: Aug. 30, 2016

(54) METHOD AND DEVICE FOR PRODUCING SNOW

(75) Inventors: Meinhard Breiling, Vienna (AT); Michael Bacher, Vienna (AT); Sergey Sokratov, Moskau (RU); Frederick Geroge Best, Baglan (GB)

(73) Assignees: TECHNISCHE UNIVERSITÄT WIEN, Vienna (AT); UNIVERSITÄT FÜR FODENKULTUR WIEN, Vienna (AT)

( * ) Notice: Subject to any disclaimer, the term of this patent is extended or adjusted under 35 U.S.C. 154(b) by 885 days.

(21) Appl. No.: 13/394,861

(22) PCT Filed: Sep. 9, 2010

(86) PCT No.: PCT/AT2010/000325

§ 371 (c)(1),
(2), (4) Date: Apr. 18, 2012

(87) PCT Pub. No.: WO2011/029115

PCT Pub. Date: Mar. 17, 2011

(65) Prior Publication Data

US 2012/0193440 A1 Aug. 2, 2012

(30) Foreign Application Priority Data

Sep. 11, 2009 (AT) ..... 1434/2009

(51) Int. Cl.
*F25C 3/00* (2006.01)
*F25C 3/04* (2006.01)

(52) U.S. Cl.
CPC . *F25C 3/04* (2013.01); *F25C 3/00* (2013.01); *F25C 2303/00* (2013.01); *F25C 2303/044* (2013.01)

(58) Field of Classification Search
CPC ..... F25C 3/00; F25C 3/04; F25C 2303/00; F25C 2303/044; A01G 15/00
See application file for complete search history.

(56) References Cited

U.S. PATENT DOCUMENTS 3,257,815 A 6/1966 Brocoff
3,408,005 A * 10/1968 Struble et al. ..... 239/14.2

(Continued)

FOREIGN PATENT DOCUMENTS

EP 0609140 A1 8/1994
EP 1065456 A1 1/2001

(Continued)

OTHER PUBLICATIONS

Office Action issued Aug. 17, 2010 in AT Application No. 2B A 1434/2009.

(Continued)

*Primary Examiner* — Ryan Reis
(74) *Attorney, Agent, or Firm* — Panitch Schwarze Belisario & Nadel LLP

(57) ABSTRACT

A method for producing substantially dendritic snow includes: a) supplying a flow of humid air (1) and a flow of cold air (9) into a substantially closed space (15, 16, 17) to mix the two air flows and create an atmosphere oversaturated with water within the space; b) forming ice crystals and allowing snowflakes to grow from the oversaturated atmosphere, keeping the ice crystals and growing snowflakes floating within the space and allowing them to grow over a predetermined period of time sufficiently long to obtain snowflakes having a predefined size, the floating condition being achieved by moving the ice crystals and growing snowflakes, on average, along a substantially helical trajectory by the air flow, which results in the snowflakes being distributed according to their size along the substantially helical trajectory; and c) thereafter releasing the predefined size snowflakes via a release opening (7) of the space by a carrier air flow (3).

40 Claims, 7 Drawing Sheets

(56) References Cited

U.S. PATENT DOCUMENTS

| | | | | | |
|---|---|---|---|---|---|
| 3,703,991 | A | * | 11/1972 | Eustis et al. | 239/2.2 |
| 3,831,844 | A | * | 8/1974 | Tropeano et al. | 239/14.2 |
| 3,969,908 | A | * | 7/1976 | Lawless et al. | 62/74 |
| 4,475,688 | A | * | 10/1984 | Hodges | 239/102.2 |
| 4,746,064 | A | | 5/1988 | Isono et al. | |
| 4,767,054 | A | | 8/1988 | Suga et al. | |
| 4,792,093 | A | | 12/1988 | Suga et al. | |
| 4,809,514 | A | | 3/1989 | Suga et al. | |
| 5,445,320 | A | | 8/1995 | Berthelier | |
| 6,402,047 | B1 | * | 6/2002 | Thomas | 239/14.2 |

FOREIGN PATENT DOCUMENTS

| | | | |
|---|---|---|---|
| EP | 1710519 | A1 | 10/2006 |
| GB | 2241316 | A | 8/1991 |
| JP | 46-007151 | B | 2/1971 |
| JP | 05-312448 | A | 11/1993 |
| JP | 06-034245 | A | 2/1994 |
| JP | 08-178492 | A | 7/1996 |
| SU | 951031 | A1 | 8/1982 |
| SU | 1617272 | A1 | 12/1990 |
| WO | 0066957 | A2 | 11/2000 |

OTHER PUBLICATIONS

Office Action issued Apr. 12, 2012 in AT Application No. 2B A 1434/2009.

Int'l Search Report issued Oct. 28, 2011 in Int'l Application No. PCT/AT2010/000325.

Rixen et al, "Does artificial snow production affect soil and vegetation of ski pistes? A review", Perspectives in Plant Ecology, Evolution and Systematics, vol. 5/4, pp. 219-230 (2003).

Hahn, "Künstliche Beschneiung im Alpenraum" ("The production of artificial snow in the Alpine region"), Cipra International, pp. 1-18 (2004).

Fierz et al, "The International Classification for Seasonal Snow on the Ground", IHP-VII Technical Documents in Hydrology, No. 83, IACD Contribution No. 1, UNESCO-IHP, Paris (2009).

Meier, "Produktion von naturidentischem Schnee" ("Producing nature-identical snow"), Diploma Thesis, ETH Zurich (2006).

* cited by examiner

METHOD AND DEVICE FOR PRODUCING SNOW

CROSS-REFERENCE TO RELATED APPLICATIONS

This application is a Section 371 of International Application No. PCT/AT2010/000325, filed Sep. 9, 2010, which was published in the German language on Mar. 17, 2011, under International Publication No. WO 2011/029115 A2 and the disclosure of which is incorporated herein by reference.

BACKGROUND OF THE INVENTION

The present invention relates to a method and a device for producing snow from flows of humid air and cold air.

Traditional snow cannons, which are widely used in ski resorts, do not produce snow as such, but only specific types of snow, mainly corresponding to fully or partly frozen water droplets (being called "sleet" or "graupel" when occurring in nature). In natural clouds, snowflakes gradually grow in the course of the re-sublimation (i.e., the phase transition from vapor phase to solid phase), and only nuclei required for the initiation of ice crystal growth can be formed by freezing. In traditional snow cannons, water is fed into a nozzle together with pressurized air, whereby the water is atomized into very fine droplets and is released into the surrounding air, where, if the ambient temperature is sufficiently low, the water will freeze to form ice, which will then fall to the ground (see, for example, F. Hahn "Künstliche Beschneiung im Alpenraum" ("The production of artificial snow in the Alpine region"), Cipra International, 2004; and M. Meier, "Produktion von naturidenti-schem Schnee" ("Producing nature-identical snow"), Diploma Thesis, ETH Zurich, 2006). An improved and modern embodiment of such a snow cannon is disclosed by L. Nilsson in European Patent Application Publication EP 1,710,519 A1, for example, while European Patent Application Publication EP 1,065,456 A1 describes a snow cannon which is operated within a closed space, such as in a tent, in order to make it possible to influence the characteristics of the flow of cold air. U.S. Pat. No. 3,257,815 describes a device for producing snow from atomized water and cold air, wherein the water mist which is falling down is frozen by contacting cold air rising from the bottom; the artificial snow is then released at the bottom end of the device.

However, artificial snow produced in this way, as well as ski slopes covered with this kind of artificial snow, have several drawbacks. First, the amounts of energy required for the production of this kind of artificial snow and the emission of noise during the production procedure are enormous. Second, the ice crystals so formed are simply not snowflakes but frozen ice droplets. This results in an increased risk of injury for skiers and snowboarders, if they fall over on such icy slopes, as well as an impairment of the skiing/snowboarding experience, as most skiers and snowboarders prefer freshly fallen snow, i.e., slopes with a cover of loose, soft, "fluffy" snow having a low density, which is also referred to as "dendritic snow." Additionally, such artificial divergence of the snow cover properties from the natural ones, formed from clouds, often implies an additional pressure on the environment, which, however, is not yet fully understood as there are very few environmental studies on this topic (see, for example, C. Rixen, V. Stoeckli, W. Ammann, "Does artificial snow production affect soil and vegetation of ski pistes? A Review," *Perspectives in Plant Ecology, Evolution and Systematics,* 5(4): 219-230 (2003)).

In nature, such dendritic snowflakes are formed while they are floating in the high air layers of the atmosphere and probably while they fall down from great altitudes, when ice crystals formed from air being supersaturated with water vapor are slowly growing into dendrites or similar snow crystals (see C. Fierz, R. L. Armstrong, Y. Durand, P. Etchevers, E. Greene, D. M. McClung, K. Nishimura, P. K. Satyawali, S. A. Sokratov, "The International Classification for Seasonal Snow on the Ground," *IHP-VII Technical Documents in Hydrology*, No. 83, IACS Contribution No. 1, UNESCO-IHP, Paris, 2009). This growing process, however, takes several minutes, which is why, so far, approaches for producing artificial or even nature-identical snow did not succeed in producing any dendritic snow at all or only yielded a few grams thereof.

Japanese patent application publication JP 46-7151 A also describes a method for producing snow using water mist and cold air. In this case, sleet and ice crystals are produced in the first of two freezing chambers which are kept at a temperature of −35 to −30° C. The sleet mixture is kept floating for several minutes in both chambers by a flow of cold air, which is blown in from the bottom, and is converted into "snow" in the second chamber. The thus obtained snow is moved to a third chamber, which is kept at a temperature of −15 to −20° C. by blowing down cold air onto the snow from above, in order to prevent the snow from being reconverted into ice, where it is stored.

In this case, the sleet, i.e. ice grains, obtained by this method may agglomerate to form larger crystal structures in the course of the "conversion phase" which lasts several minutes. However, the formation of the above described "fluffy" or dendritic snow is not possible in this case either, because this type of snow is only produced from an atmosphere oversaturated with vapor. It is not possible to create such an atmosphere by the method according to JP 46-7151 A in the first place: because of the low temperature (−35 to −30° C.) in the first freezing chamber, the water droplets spontaneously freeze into ice droplets and sleet. Subsequently, the humidity in each chamber will correspond to the respective temperature therein, but it will not be possible to achieve an oversaturation of the atmosphere, especially because the atmosphere is not further cooled in the subsequent chambers, but also additional non-humidified "dry" air is supplied and, in the third chamber, significantly warmer air is used.

Russian published patent application 1,617,272 A1 describes a "snow generator," in which a flow of cold air is divided, so that one of the partial air flows passes through a humidifier and is afterwards additionally contacted with water mist while moving upwards into a snow production chamber. This partial air flow, which contains both vapor and water droplets and which has been warmed due to the contact with water, is mixed with the second partial flow of cold air, which creates an atmosphere oversaturated with vapor, and first snow starts to form. Then, the combined air flow passes through the production chamber where it is further cooled by cooling tubes in order to form more snow. After that, the snow is blown out into a cyclone, where it is deposited and thus separated from the air flow, which is recycled to provide the flow of cold air. Concerning the residence time of the snow thus obtained in the production chamber or concerning its structure, no information is given.

For this reason, it may be assumed that the water droplets present in the partial flow of humidified air again become sleet, when the flow of humidified air is mixed with the flow of cold air, the sleet increasing in size when passing through the production chamber, due to water molecules precipitating from the oversaturated atmosphere. As there are no measures for increasing the residence time in the production chamber, it will again not be possible to produce "fluffy," dendritic snow using this device.

M. Meier, supra, describes an approach for producing nature-identical snow using a "snow machine" in which cold air is blown over a heated water basin within a cooled closed space, which causes the air to take up moisture. The air is then cooled while it rises and thus becomes supersaturated with water. In the top area of the machine, the water condenses on nylon threads, which leads to the growth of snow crystals thereon. As soon as these crystals have reached a certain size, they fall down from the threads and are collected in a drawer positioned underneath. The snowflakes may have a more or less dendritic structure, but even when the experiment is carried out for several hours, no more than 1 to 2 kg snow can be produced. This means that this device is not suitable for producing snow for ski slopes.

European Patent Application Publication EP 609,140 A1 discloses the production of snow within a closed tunnel in which the snow circulates and which may therefore be used as a snow channel for testing various materials and articles under the influence of snow fall. Except for its moisture content, the characteristics of the thus obtained snow are not described, and the device described therein is not suited for the production of snow for ski slopes either.

BRIEF SUMMARY OF THE INVENTION

Against this background, it was the aim of the present invention to provide a method and a device for producing snow being as nature-identical as possible, i.e. substantially dendritic, which method and device may be carried out or operated, respectively, in an energy saving manner and are suitable for use for ski slopes.

In a first aspect, the present invention reaches this aim by providing a method for producing substantially dendritic snow, the method comprising the following steps:

a) feeding a flow of humid and a flow of cold air into a substantially closed space in order to mix the two air flows therein, thus forming an atmosphere supersaturated with water within the space;

b) forming ice crystals and allowing snowflakes to grow from the supersaturated atmosphere within the substantially closed space while keeping the growing ice crystals and snowflakes floating therein and allowing them to grow for a predetermined period of time which is sufficient to obtain snowflakes of a predefined size;

the condition of floating being achieved by moving the growing ice crystals and snowflakes, on average, along a substantially helical trajectory by the air flow, which results in the snowflakes being distributed according to their size along the substantially helical trajectory;

c) releasing the snowflakes having the predefined size after the predetermined period of time by a carrier air flow through a release opening of the substantially closed space.

By keeping the growing ice and snow crystals floating within the substantially closed space, water vapor is enabled to continuously re-sublimate (deposit) from the supersaturated atmosphere onto the surface of the crystal nuclei and then onto the surface of growing crystals, which enables the crystals to grow into snowflakes of a desired size. Hence, the size of the snowflakes mainly depends on the period of time provided for their growth. Thus, the method of the invention makes it possible to simulate the conditions snowflakes are subjected to in nature and to produce snow which is as nature-identical as possible. Additionally, compared to the operation of traditional snow cannons, the present invention significantly reduces the amount of energy required for producing a certain amount of snow, and the emission of noise is practically entirely eliminated.

Due to the fact that the air flow moves the ice and snow crystals along a substantially helical trajectory, the distance covered by the crystals within the substantially closed space is many times greater than the distance covered when using an uncontrolled air current, which allows for a significantly increased residence time.

The period of time required for obtaining snowflakes of the predefined size, e.g. for obtaining the above-described dendritic snow, depends, among other things, on the shape and the dimensions of the substantially closed space, the supply rates of the two air flows, their temperatures, and the moisture content of the humid air, and has to be determined empirically for each individual case when implementing the method of the invention. Of course, economic considerations will play a role in this connection. In order to obtain large, voluminous snowflakes, i.e. substantially dendritic snowflakes, as they can be found in nature, by the method of the invention, the predetermined period of time in step b) preferably amounts to at least about 5 min, more preferably to at least 10 min or at least 15 min. This means that the predefined size in step b) preferably is in the order of dendritic snowflakes. Moreover, the method of the invention preferably produces snow having a density of less than 200 $kg/m^3$, which is perfectly suited as a material for artificial snow covers for ski slopes.

The phrase that the air flow moves the growing ice crystals and snowflakes "on average" along a substantially helical trajectory in step b) means that the snowflakes and ice crystals, which are whirled up and transported by the combined air flow and which, of course, are not all transported on an imaginary helical trajectory, move through the substantially closed space in such a way that the mass flow resulting from the individual movements of the snowflakes follows a substantially helical trajectory. Whether this mass movement closely corresponds to a helical form or not, of course, also depends on the sectional shape of the substantially closed space. It is clear that the movement comes closest to the helical form in the case of circular sections.

It is noted that the snowflakes' weight increases when they grow, but, at the same time, their specific surface area gets larger, so that they are more easily transported and carried away by the air. For this reason, while they are floating and moving along the substantially helical trajectory within the substantially closed space, the growing snowflakes are distributed in a way that, in the case of an upward helical movement, larger flakes are found at greater heights, while smaller flakes and ice crystal nuclei are found at lower heights. In the topmost area of the substantially closed space, the snowflakes have substantially reached the size and shape of nature-identical dendritic snowflakes.

In the course of step a) of the method of the invention, one or more additives for supporting the formation/growth of crystals in step b) are preferably supplied together with the flow of humid air and/or with the flow of cold air, whereby these two processes can be significantly accelerated, which increases the cost effectiveness of the method.

Preferably, ice crystal nuclei are supplied as additives together with the flow of humid air and/or with the flow of cold air in order to initiate the formation of ice crystals and/or to promote the growth of ice crystals. Additionally or alternatively, one or more foaming agents for producing air bubbles, on the surface of which the formation of ice crystals is initiated, may be supplied. In this way, the amount of snow produced per time unit, i.e., the density of the snowflakes in the atmosphere of the substantially closed space, can be increased.

The way in which the ice crystals and snowflakes are kept floating and their movement on the substantially helical trajectory is achieved in step b) is not subject to any particular limitations. In preferred embodiments, at least one of the two flows of humid and cold air is fed into the substantially closed space from below at an oblique angle. Alternatively or additionally, at least one of the two flows of humid and cold air is laterally supplied to the substantially closed space.

More preferably, at least one of the flows of humid and cold air in step a) is fed in a substantially tangential direction into a substantially closed space that is conical, which makes it easier to obtain a rotational movement and, at the same time, initiates an upward movement, which results in the desired helical trajectory.

According to the invention, a combination of lateral and bottom air flow supplies, i.e., supplying at least one air flow from below at an oblique angle and at least one air flow laterally, especially in a tangential direction into a conical space, is particularly preferred in order to create a stable upward rotational movement and to be in the position to control this movement by an adequate adaptation of the volume flows. In this way, the residence time of the snowflakes produced by the method of the invention and the thus obtainable size of the same can be controlled.

It is not decisive which air flow is supplied from the bottom and which one is supplied laterally. Due to the fact that warm air rises, while cold air sinks, a flow of cold air will rather be supplied laterally, while a flow of humid air, which, compared to the flow of cold air, is warmer, will be supplied from the bottom. An embodiment of the method in which both humid air and cold air are supplied both laterally and from the bottom is especially preferred. In this way, multiple sites for the formation of crystal nuclei are provided, which increases the number of snowflakes produced per time unit and thus the density of snowflakes in the atmosphere within the substantially closed space.

As an alternative or in addition to the above methods, the growing snowflakes in step b) may also be transported along the substantially helical trajectory by one or more fans provided in the substantially closed space. Such fans preferably only support the air movements created by the way in which the air flows are supplied into the space, or, considering the additional energy they would require, are not provided at all.

The temperature of the flow of cold air in step a) is only subject to the limitation that it has to be below 0° C. Preferably, however, the temperature is in the range of −100° C. to −5° C., more preferably in the range of −20° C. to −5° C. The cold air may be pre-cooled in order to obtain the desired temperature, or it may simply be ambient air that is supplied as the flow of cold air, if it has the required temperature below the freezing point. Of course, the latter way is preferred due to the lower consumption of energy.

According to the present invention, the temperature of the flow of humid air in step a) is not subject to any particular limitations. Preferably, a compromise is struck between a higher temperature at which the degree of the air's saturation with water is higher and a lower temperature at which the amount of cold air required for obtaining a temperature below 0° C. within the substantially closed space is lower. The temperature of the flow of humid air, thus, preferably is in the range of −5° C. to +10° C.

An embodiment of the invention in which the ambient air is separately moistened and supplied into the substantially closed space as the flow of humid air is preferred. The supplied humid air is preferably warmed before or while moisture is added thereto in order to raise the water saturation point. This way of supplying water is not subject to any particular limitations. Preferably, the water is absorbed when an air flow is blown over an open water container and/or through a water container. In both cases, the water container may be heated.

In preferred embodiments of the invention, the surface of the substantially closed space is at least partially cooled and/or heated in order to specifically prevent or promote the condensation of water in certain areas of the surface. The top area of a conical space, in which mainly larger snowflakes are to be found, may, for example, be cooled in order to prevent these larger flakes from condensing.

The energy used for heating the surface of the substantially closed space, the flow of humid air, or the water container, preferably is the waste heat resulting from a cooling process carried out as part of the method, e.g. from the above-mentioned cooling of the surface or from the additional cooling of the cold air. In this way, the energy required for carrying out the method can be further reduced.

In step c) of the method the snowflakes are preferably released from the substantially closed space together with the carrier air flow through a nozzle in order to accelerate the snowflakes to the required speed, so that it is possible to cover the area around the production site with the snow produced by the method of the invention. In particularly preferred embodiments, the snowflakes are released through a Venturi nozzle which is operated using a flow of ambient air, by which a negative pressure is created in the top area of the substantially closed space, the negative pressure sucking the snowflakes present in the top area, i.e. snowflakes of the predefined size, into the nozzle.

However, in step c) the snowflakes can also be released into a storage container in order to store them for any later application, e.g. for covering ski slopes with snow or for the preservation of food. To the latter end, it is preferred to use sterilized water for the generation of the flow of humid air.

In a second aspect, the present invention provides a device for producing substantially dendritic snow by carrying out the method of the first aspect, the device comprising at least one substantially closed chamber which in turn comprises:

at least one supply line for a flow of humid air and at least one supply line for a flow of cold air;

three zones being in fluid communication with one another, namely: a mixing zone, into which at least one supply line for humid air and at least one supply line for cold air lead, for mixing the flows of humid and cold air and, optionally, for forming ice crystal nuclei; a growth zone for snowflakes; and a release zone where the produced snowflakes are released;

means for transporting the ice crystal nuclei and snowflakes along a substantially helical trajectory, which means are provided in at least one zone; and a release opening which is in fluid communication with the release zone.

In such a device which is divided into the above-mentioned three zones, the above-described method of the invention may be carried out in an especially advantageous manner. In this connection it is noted that this "division" does not necessarily refer to a spatial separation and that a "zone" does not necessarily constitute a spatially separated area. A "zone" may thus also only refer to an area of the space within a chamber in which mainly one of the processes being part of the inventive method, i.e. the mixing of the air flows, the growing of snowflakes, and the release of the snowflakes via the release opening, is taking place. This means that all three zones may also be provided within a single, substantially closed chamber, without being clearly delineated, i.e. without any physical boundaries.

Alternatively, a separate substantially closed chamber for each of the three zones, or a chamber for two of the three zones and a second chamber for the third zone, may be provided. The device may comprise several substantially closed chambers which may be connected in series or in parallel, each of the chambers comprising either all three zones or only one or two of the zones. If one chamber comprises more than one zone, different built-in fittings may be provided for partially separating the zones. However, it is preferred that all three processes are carried out within one single chamber.

The type(s) and shape(s) of the chamber(s) is (are) not subject to any particular limitations. According to the present invention, the flows of humid and cold air may also be introduced into a single tubular chamber which is helically wound upwards or downwards, which makes the combined air flow, on average, follow the desired helical trajectory. As such a tubular chamber would be required to be very long in order to produce substantially dendritic snowflakes, such embodiments are not preferred, while chambers having a significantly lower aspect ratio between length and height, e.g. an aspect ratio <10:1, are preferred.

The means for moving the ice crystal nuclei and snowflakes along a substantially helical trajectory are not subject to any particular limitations, so that it is possible to use any air flow control means such as fans, various fittings, e.g. deflector plates, ridges, and grooves in the inner surface of the chamber(s). However, it is preferred to use at least one air supply line and/or at least one air flow control means, preferably a fan, as such means. It is especially preferred to exclusively use one or more air supply lines as the inventive means for moving the ice crystal nuclei and snowflakes along a substantially helical trajectory, which will be explained in further detail below.

The substantially closed chamber or, if the device comprises more than one chamber, one or more substantially closed chambers, preferably is/are conical at least in the area of the release zone in order to create a stable, substantially helical air movement towards the release opening. Alternatively or additionally, such chambers may also be conical in the areas of the growth zone and the release zone in order to provide a stable, substantially helical movement in these areas so as to allow for a more precise control of the residence time of the snowflakes in the individual zones. For the same reason, such a chamber preferably is entirely conical.

As has already been described in connection with the method of the present invention, at least one supply line for humid air and/or at least one supply line for cold air enter(s) the mixing zone from below at an oblique angle in order to cause the substantially helical movement of the air within the chamber and thus to serve as the means for moving the ice crystal nuclei and snowflakes along a substantially helical trajectory. Alternatively or additionally, in preferred embodiments, at least one supply line for humid air and/or at least one supply line for cold air laterally enter(s) the mixing zone and/or the growth zone. It is especially preferred that at least one supply line for humid air and/or at least one supply line for cold air enter(s) a conical mixing zone and/or growth zone in a substantially tangential direction, which provides for a substantially helical trajectory with a low pitch and thus for an extended residence time of the snowflakes within the chamber. On the other hand, at equal residence times, the height of the chamber required for obtaining substantially dendritic snowflakes may be reduced by choosing a low pitch.

The release opening preferably is a nozzle, more preferably a Venturi nozzle, in order to provide the snowflakes produced in the device of the invention with a sufficiently high speed for them to cover the surrounding area, especially by being sucked into the nozzle in the release zone by the negative pressure created by the Venturi nozzle. The Venturi nozzle is preferably operated with ambient air.

The type and position of the supply lines for humid and cold air are not subject to any particular limitations. Both air flows are preferably pumped into the device at a defined flow rate in order to allow for a precise control of the residence time of the snowflakes. Moreover, the entry points of at least one supply line for humid air and of at least one supply line for cold air are substantially positioned next to each other, forming an angle of <180°, more preferably an angle of 90°, in order to make the air flows flow towards each other so as to mix them and to make the resulting air mixture simultaneously flow away in a defined direction. Alternatively or additionally, the entry points of at least one supply line for humid air and of at least one supply line for cold air may be positioned opposite each other, forming an angle of 180°, which results in a more intimate mixing within a smaller area of the mixing zone.

In a preferred embodiment, one of at least one supply line for humid air and at least one supply line for cold air is positioned within the other, preferably concentrically, both supply lines having a common point of entry into the chamber. This embodiment also results in an intimate mixing of the two air flows immediately after they have entered the mixing zone of the chamber and, additionally, offers the possibility of a heat exchange between the two air flows via the walls of the inner supply line. In such embodiments, the inner one of the two supply lines, positioned one within the other, preferably ends before the common point of entry into the chamber, more preferably a short distance, e.g. a few centimeters, before the chamber, in order to achieve partial mixing of the two air flows already before their entry into the chamber.

According to the present invention, one or more parts of the device, preferably the outer wall(s) of the chamber and/or the supply lines for the cold air, may be provided with a cooler and/or a heater. As already described above in connection with the method of the present invention, provides, for example, for a possibility of cooling the outer wall of the chamber in order to prevent the snowflakes from sticking or melting thereon. Or the supplied air flows may be cooled or heated before entering the chamber in order to cool or heat them to the temperature which is best suited for their entry into the chamber. It is especially preferred to provide at least one heater for heating the supplied humid air. This heater may, for example, consist in a heated water container through which or over which the air, e.g. ambient air, is blown in order to load it with moisture.

Generally, the cooler and heater, which are optionally used in the method and the device of the present invention, are not subject to any particular limitations. For those skilled in the art, i.e. experts in the construction of machinery and plants, it will not constitute a problem to select the solution which is best suited for the respective purpose, also considering the respective energy requirements. Especially for the cooling of the outer wall of the chamber, a cooling jacket or a cooling fan may be used. The supply lines for the air flows may, for example, also be cooled by a cooling jacket or by simply covering them with snow. Preferably, a combination of cooler and heater is applied by using the waste heat of a cooler for heating another part of the device in order to increase its energy efficiency. In a similar way, the water used to humidify the humid air flow can be either supplied at a temperature around 0° C. or warmed to any desired temperature with minimal energy requirements, i.e. by using such waste heat.

An especially preferred embodiment of the inventive device is transportable in order to make it possible to use the same device for consecutively producing snow for different sections of one ski slope. To this end, the at least one chamber is, at least partially, made of a light-weight material which is selected from cloth, canvas, and plastic.

Moreover, the at least one chamber is preferably at least partially made of and/or lined with a material which inhibits the growth of ice crystals. For this purpose, mainly hydrophobic materials such as plastics, especially silicones or silicone-covered materials, may be used.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
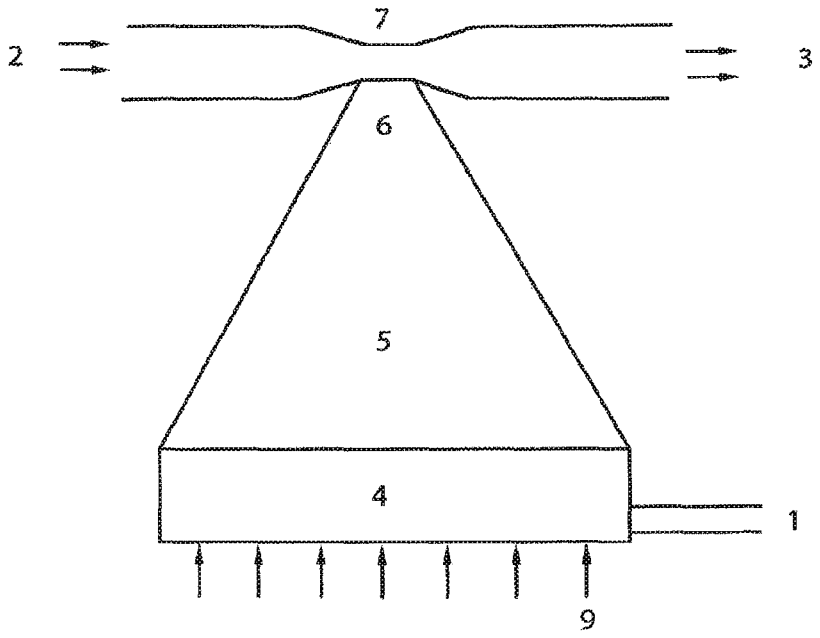
FIG. 1 is a schematic vertical sectional view of an embodiment of the device of the present invention.

FIG. 1 shows a schematic vertical sectional view of a preferred embodiment of the device of the present invention for carrying out the method of the present invention. The device comprises a single substantially closed chamber which comprises three zones 4, 5, and 6, supply lines for humid air 1 and for cold air 9 entering the mixing zone 4. For the cold air, several supply lines are provided, which may, for example, be implemented in the form of one line with several outlets immediately below the chamber.

As the flow of humid air, for example, it is possible to use ambient air which is loaded with moisture before entering the chamber, e.g. by blowing the air flow over or through a water basin, optionally while additionally warming the air flow and/or the water. According to the research results of the inventors, the temperature of the flow of humid air should not increase to more than about +10° C. in order to prevent the need for an excessively large volume of cold air for obtaining a temperature below 0° C. within the chamber. To ensure that the air flow has sufficiently high moisture content for producing as large an amount of snow as possible per air volume unit, the temperature should not normally be lower than −5° C. either.

However, it is also possible to exchange the flows of humid and cold air in FIG. 1, so that the numeral 9 would refer to the supply line for humid air, while 1 would refer to the supply line for cold air. In this case, an optionally heated water container could be provided immediately below the chamber, through which container ambient air is blown before entering the chamber as a flow of humid air, while cold air is laterally supplied.

In any case, if the two air flows are supplied in the way shown in the figure, both an upward and a rotational movement, and thus a substantially helical movement, are caused within the chamber which, above the mixing zone 4, is provided in a shape tapered towards the top. This means that, in the areas of the growth zone 5 and the release zone 6, the chamber is conical, which promotes the substantially helical movement of the atmosphere therein and allows for a more precise control of the residence time of the snowflakes growing therein.

The optimum relation between the two air flows has to be selected depending on the structural implementation of the device of the present invention and the air temperatures. The only important things are that the air flows are mixed thoroughly and that the air temperature within the chamber is below the freezing point.

In FIG. 1 a spatial separation, which may consist of a perforated metal plate or the like and may result in a more thorough mixing of the two air flows in the mixing zone 4 and, occasionally, in the formation of a higher number of crystal nuclei, before the air mixture with the snowflakes growing therein enters the growth zone, is provided between the zones 4 and 5. The formation of crystal nuclei usually occurs spontaneously when humid air and cold air meet, due to the air's resulting oversaturation with water. As has already been mentioned, different additives may be supplied to the chamber together with one or both of the two air flows in order to facilitate the formation of crystal nuclei. Of course, the environmental compatibility of such optional additives has to be taken into account. Preferably, mainly additional ice crystal nuclei are supplied together with the cold air in order to obtain a higher density of growing snowflakes.

After the transition into the growth zone 5, additional water condenses from the over-saturated air in the form of ice crystals which adhere to the crystal nuclei and the growing snowflakes and thus gradually form voluminous and thus substantially dendritic snowflakes. The required period of time depends, among other things, on the moisture content of the air, the temperature of the air mixture, the density of the crystal nuclei and the growing snowflakes in the atmosphere within the chamber, and the rate of movement within the chamber, and usually amounts to between 5 and 15 minutes. The throughput of the method of the present invention and thus of the device of the present invention, i.e. mainly the volume of the two air flows supplied per time unit, has to be regulated in order to make sure that the snowflakes are allowed to grow within the device for a predetermined period of time, so that snowflakes of a desired size can be released. This period of time has to be determined empirically for every embodiment of the device of the present invention. However, in order to produce a cover of loose, substantially nature-identical, low density snow, the period of time should amount to at least 5 minutes, more preferably to at least 10 minutes, and especially to at least 15 minutes.

As already mentioned, due to their larger surface, larger snowflakes are more easily carried away and transported by the air and, with increasing size, cover an ever larger distance on the substantially helical trajectory, i.e. they are found ever closer to the top of the chamber in the embodiments shown in the figure. When they have reached the desired size, they enter the release zone 6. They are sucked out of the release zone 6 by the Venturi nozzle 7 shown in FIG. 1 and are then released from the chamber. In the embodiment in FIG. 1 in which no spatial separation is provided between the growth zone 5 and the release zone 6, this means that the release zone 6 starts in an area where the negative pressure created by the nozzle 7 is sufficiently high for sucking out the snowflakes.

The Venturi nozzle 7 is preferably operated with a flow of ambient air 2 which is optionally pre-cooled, which, however, is not preferred as it results in an increase of the energy required. The resulting carrier air flow 3 transports the snowflakes out of the device where they form a snow cover around the device. On the one hand, the pressure of the nozzle air flow 2 has to be selected adequately to make sure that only snowflakes of the predefined size are sucked in by the resulting negative pressure, i.e. to make sure that the release zone 6 does not extend to far down in the device. On the other hand, the pressure has to be sufficiently high for transporting the snowflakes with the carrier air flow 3 over an adequate distance away from the device in order to make it possible to cover with snow as large an area as possible around the device.

As already mentioned, the material the chamber is made from is not subject to any particular limitations. Preferably, it is a light-weight material such as cloth, canvas, or plastic, a plastic film material, for example, in order to make the device transportable, and/or a material which inhibits the growth of ice crystals on the walls. Additionally, some areas of the device may be lined with the latter material. Moreover, as described above, some areas of the device may be cooled and/or heated, if desired.

Figure 2:
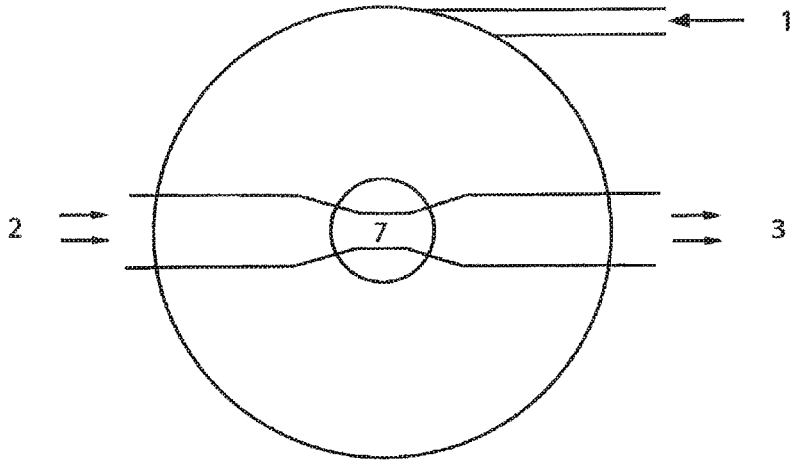
FIG. 2 is a schematic top view of the embodiment of FIG. 1.

FIG. 2 is a schematic top view of the device of FIG. 1, showing that the air flow 1 is supplied in a substantially tangential direction into the chamber, which favors the creation of a stable helical movement.

Figure 3:
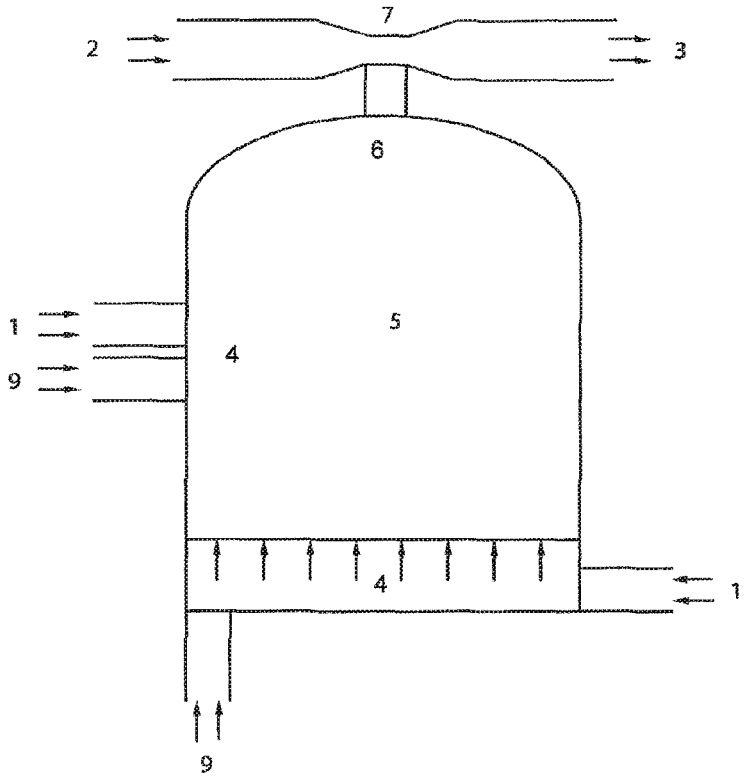
FIG. 3 is a schematic vertical sectional view of another embodiment of the device of the present invention.

FIG. 3 shows a schematic vertical sectional view of another embodiment of a device of the present invention for carrying out the method of the present invention. This figure shows two supply lines, one for humid air 1 and one for cold air 9, leading into a cylindrical chamber with a dome-shaped top part (again, it is possible to exchange the positions of these supply lines). In this case, the chamber comprises two mixing zones 4, which means that some of the snowflakes which have grown in the lower mixing zone 4 and have already moved to the growth zone 5 are contacted with additional smaller crystals having been generated in the upper mixing zone 4. This triggers a second burst of growth, which results in a more rapid formation of larger snowflakes as well as in a higher flake density in the atmosphere within the chamber.

As the chamber is dome-shaped, the release zone 6 does not extend as far down into the chamber as described for the conical embodiment, which, if the chamber volume and the nozzle pressure are the same, results in a longer residence time of the snowflakes within the chamber.

Figure 4:
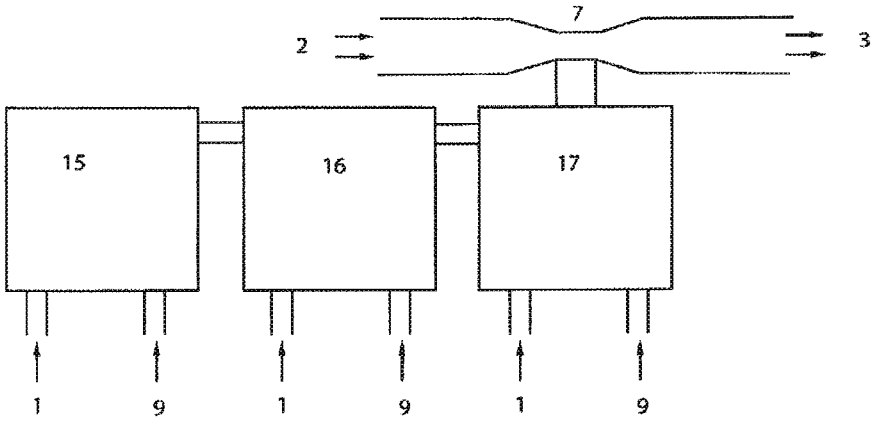
FIG. 4 is a schematic vertical sectional view of a further embodiment of the device of the present invention.

FIG. 4 is a schematic vertical sectional view of a further embodiment of a device of the present invention for carrying out the inventive method. In this case, three chambers 15, 16, and 17 are provided, each of which comprises a supply line 1 for humid air and a supply line 9 for cold air, the chambers 15, 16, and 17 being connected in series. This means that a snowflake growth mixture formed in chamber 15 is transferred to chamber 16 and, subsequently, to chamber 17, so that in both chambers such a mixture is formed, too. For this reason, each of the three chambers comprises a mixing zone, a growth zone, and a release zone (not shown), the release zones of the first two chambers 15 and 16 being limited to a very small area around the outlet of the respective chamber and the inlet of the transfer line leading into the next chamber. Only the last chamber 17 which is provided with a Venturi nozzle as a release opening 7 has a release zone which, due to the Venturi effect of the nozzle, extends further down into the chamber and from which snowflakes having the predefined size are sucked into the nozzle.

The effect of such a three-stage device is similar to the effect which has been described above referring to FIG. 3: In the two subsequent chambers 16 and 17, two additional bursts of growth are triggered within the air mixture formed in the first chamber 15. Moreover, it is possible to produce a greater number of snowflakes, i.e. a larger amount of snow, than in just one chamber. In FIG. 4, the dimensions of the three chambers are the same, they can, however, be freely chosen in such embodiments. This means that, for example, the first chamber 15 may be relatively large, while the subsequent two chambers 16 and 17 are smaller, and vice versa.

Moreover, the chambers may have the same or different sections, and the relation between the volume flows of the flow 1 of humid air and of the flow 9 of cold air may be the same or different in the chambers. Apart from that, it is possible to supply only one of the flows to the second and all subsequent chambers, for example only cold air 9 in order to decrease the temperature of the air mixture in the device in the course of procedure, or only humid air 1 in order to increase the moisture content within the device.

While the three chambers in FIG. 4, for reasons of simplicity, are illustrated in a rectangular shape, all of them, especially chamber 17, preferably have a circular section and a conical, upward tapered shape, in order to facilitate a helical movement of the air flow. Apart from that, in FIG. 4, the supply lines 1 and 9 are shown to enter the chambers at right angles, but at least one of the supply lines should enter the respective chamber at an oblique angle in order to guarantee the generation of the helical movement. If the chambers are constructed in the way shown in FIG. 4, one or even several additional air flow control units such as fans and lateral deflector plates would be required per chamber, in order to provide the desired helical movement.

According to the present invention, the chambers, which can be arbitrarily dimensioned, may be combined in all possible ways and connected in series or in parallel in order to reach the goals of the present invention, i.e. especially the production of snow which is as nature-identical as possible. What is important is that the growing snowflakes are kept floating in an oversaturated atmosphere, while they move along the helical trajectory, until their size has reached the predefined value.

Figure 5:
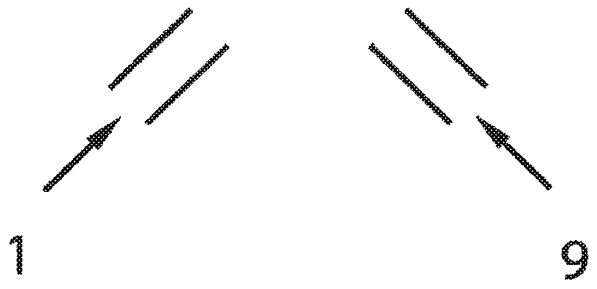
FIGS. 5-7 are flow diagrams showing different embodiments of the way in which the flows of humid and cold air may be positioned in relation to one another.
Figure 6:
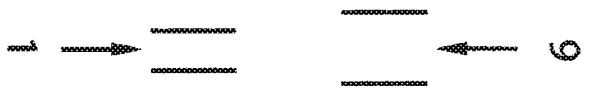
Figure 7:
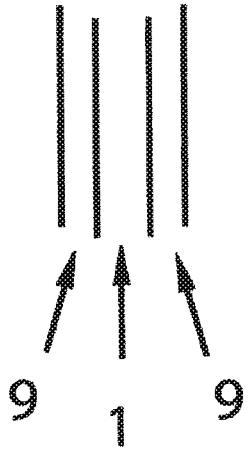

FIGS. 5 to 7 show three possible ways in which the two flows, one of humid air and one of cold air, can be mixed. In FIG. 5, the supply lines 1 and 9 form an angle of about 90°, so that, in addition to being mixed when they meet, the air flows are directed into a defined direction, which, in this case, is the direction of the angle's bisector, if the volume flows are equal.

In FIG. 6, the two supply lines 1 and 9 form an angle of 180° and are facing each other, the supply line 9 having a significantly larger diameter than the supply line 1. Depending on the pressure conditions, this can result in a larger volume of one air flow (in this case: of cold air) meeting a smaller volume of the other air flow, or in one air flow (again, in this case: of cold air) having a lower flow rate. In both cases, both the direction and the temperature of the resulting air mixture and thus the growth conditions for the snowflakes may be controlled.

FIG. 7 finally shows a case in which the supply line 1 for humid air is positioned, preferably concentrically, within the supply line 9 for cold air, which (if the material the lines are made of is appropriately selected) results in a heat exchange between the two lines, taking place even before the two air flows enter the chamber, so that the humid air flow is already oversaturated with water when entering the chamber. Moreover, it may be noticed that the supply line 1 already ends before its entry into the chamber (which is indicated as the upper end of the supply line 9 in the figure), which results in a partial pre-mixing of the two air flows before they enter the chamber.

Below, the invention will be described referring to two specific working examples which only serve the purpose of illustration and shall not to be construed as limiting in any way.

EXAMPLES

Example 1

The device of the present invention consisted of a chamber in the form of a truncated cone with a height of 95 cm, a circular base with a diameter of 100 cm, and a circular top opening with a diameter of 10 cm. A plastic funnel with a height of 10 cm and a top opening diameter of 0.5 cm was placed on the top opening as a release nozzle, the bottom edge of the funnel being air-tightly glued to the outer surface of the chamber. The chamber thus had an overall height of 105 cm and an overall volume of about 0.27 $m^3$. At a height of about 2 cm, supply lines for humid and cold air, one of which was positioned concentrically within the other, entered the chamber in a tangential direction, the supply line for humid air being positioned within the supply line for cold air. In a cold laboratory, the entire device was cooled to a temperature of −15° C.

The flow of humid air was generated by blowing air through an ice-cooled flow cell filled with water having a temperature close to its freezing point, i.e. a temperature of 1 to 2° C., the air being thus saturated with vapor and subsequently enriched with tiny water droplets using an ultrasonic nebulizer, the water droplets serving the purpose of forming crystal nuclei. Ambient air from the cold laboratory having a temperature of −15° C. was used as the cold air. Both air flows were supplied to the cooled chamber at a flow rate of between 0.2 and 0.3 L/s. When entering the chamber, the temperature of the humid air amounted to about +3° C., and the temperature within the chamber amounted to about −14° C. Due to the fact that the air flows were supplied into the chamber in a tangential direction, the mixed air flows created an upward circular flow therein.

According to calculations based on the relations between the volumes of the two air flows and the volume of the chamber and on the assumption that the supplied air flows through the entire chamber volume, the period of time during which the growing snowflakes remain within the chamber amounts to about 9 min.

Snow was continuously released via the release opening of the device. It was possible to produce about 0.2 kg snow per hour, the crystal structure of which was examined under the microscope. In this examination, in addition to a small amount of thin needles, mainly dendrites were found. The density of the thus produced, almost nature-identical snow amounted to between 90 and 120 kg/$m^3$.

Example 2

The device substantially corresponded to the device used in the first example, except for the fact that the humid air was enriched with water after having passed through the flow cell using finely dispersed water, which was obtained by a high-pressure atomizer instead of the ultrasonic nebulizer. The air flows were introduced into the chamber in the same way as described in Example 1, and the characteristics of the obtained snow practically corresponded to those of the snow produced in Example 1. However, it was possible to increase the snow production to about 9 kg per hour, which constitutes a 45-fold increase.

Currently, research is under way in order to provide for an adequate up-scaling of the device for practical applications, such as the production of snow for ski slopes.

By the method and the device of the present invention it is thus possible to produce substantially dendritic snow requiring significantly less energy than prior art methods and causing practically no noise emissions. This provides numerous excellent industrial applications, such as the production of snow for ski slopes (also indoor ski slopes), the production of snow for large open areas for other winter sports, the optimization of agricultural engineering, the production of snow for small areas in housing blocks or for gardens, parks, buildings, or school premises for sports, recreational and insulation purposes as well as the cooling or preservation of beverages or food, but also the possibility of influencing local bio- and microclimates by locally increasing the albedo of the earth's surface.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method for producing substantially dendritic snow, comprising the following steps:

a) supplying a flow of humid air and a flow of cold air into a substantially closed space in order to mix the two air flows therein and to form an atmosphere supersaturated with water within the substantially closed space;

b) forming ice crystals including ice crystal nuclei and allowing snowflakes to grow from the supersaturated atmosphere depositing onto surfaces of the ice crystal nuclei and then onto surfaces of the growing snowflakes within the substantially closed space while keeping the ice crystals and growing snowflakes within the substantially closed space in a floating condition and allowing them to grow for a predetermined period of time sufficient to obtain snowflakes of a predefined size; wherein the floating condition is achieved by moving the ice crystals and growing snowflakes, on average, along a substantially helical trajectory by the air flows, which results in the snowflakes being distributed according to their size along the substantially helical trajectory; and c) releasing substantially dendritic snowflakes having the predefined size after the predetermined period of time by a carrier air flow through a release opening of the substantially closed space.

2. The method according to claim 1, wherein, in step a) one or more additives for promoting the formation of ice crystals and/or the growth of snowflakes in step b) are supplied together with the flow of humid air and/or the flow of cold air.

3. The method according to claim 2, wherein ice crystal nuclei are supplied together with the flow of humid air and/or the flow of cold air in order to initiate the formation of ice crystals and/or to promote the growth of snowflakes.

4. The method according to claim 2, wherein at least one foaming agent is supplied together with the flow of humid air in order to form air bubbles, wherein the formation of ice crystals is initiated at a surface of the air bubbles.

5. The method according to claim 1, wherein in step a) at least one of the two air flows of humid and cold air is supplied into the substantially closed space from the bottom at an oblique angle.

6. The method according to claim 1, wherein in step a) at least one of the two air flows of humid and cold air is laterally supplied into the substantially closed space.

7. The method according to claim 6, wherein in step a) at least one of the two air flows of humid and cold air is supplied in a substantially tangential direction into the substantially closed space which is conical is conical in shape.

8. The method according to claim 1, wherein in step b) the growing snowflakes are moved along the substantially helical trajectory by at least one fan provided in the substantially closed space.

9. The method according to claim 1, wherein in step b) the predetermined period of time amounts to at least about 5 min.

10. The method according to claim 1, wherein in step b) the predefined size is in an order of that of dendritic snowflakes.

11. The method according to claim 1, wherein in step a) the flow of cold air has a temperature in a range of −100° C. to −5° C.

12. The method according to claim 1, wherein ambient air is supplied as the flow of cold air.

13. The method according to claim 1, wherein in step a) the flow of humid air has a temperature in a range of −5° C. to +10° C.

14. The method according to claim 1, wherein in step c) the subsantially dendritic snowflakes are released through a nozzle together with the carrier air flow.

15. The method according to claim 14, wherein the substantially dendritic snowflakes are released through a Venturi nozzle, which is operated using a flow of ambient air.

16. The method according to claim 1, wherein a surface of the substantially closed space is at least partially cooled and/or heated.

17. The method according to claim 1, wherein the supplied flow of humid air is heated before and/or while moisture is added thereto.

18. The method according to claim 17, including a cooling process and wherein waste heat of the cooling process is used for heating.

19. The method according to claim 1, wherein snow having a density of not more than 200 kg/m$^3$ is produced.

20. A device for producing substantially dendritic snow using the method according to claim 1, the device comprising at least one substantially closed chamber which comprises:

at least one first supply line for a flow of humid air and at least one second supply line for a flow of cold air into the substantially close space;

three zones in fluid communication with one another including: a mixing zone, into which the at least one first supply line and the at least one second supply line lead, for mixing the flows of humid and cold air and optionally for forming ice crystal nuclei; a snowflake growth zone; and a release zone for releasing the substantially dendritic snowflakes;

means for moving the ice crystal nuclei and snowflakes along the substantially helical trajectory, the moving means being provided in at least one of the three zones; and a release opening in fluid communication with the release zone.

21. The device according to claim 20, wherein at least one of the supply lines and/or at least one air flow control unit serves as the means for moving the ice crystal nuclei and snowflakes along a substantially helical trajectory.

22. The device according to claim 21, wherein at least one fan is provided as the air flow control unit.

23. The device according to claim 20, comprising a plurality of substantially closed chambers connected in series or in parallel.

24. The device according to claim 20, wherein the at least one substantially closed chamber is conical at least in a region of the release zone.

25. The device according to claim 24, wherein the at least one substantially closed chamber is conical in regions of the growth zone and the release zone.

26. The device according to claim 24, wherein the at least one substantially closed chamber is entirely conical.

27. The device according to claim 20, wherein the at least one first supply line for humid air and/or the at least one second supply line for cold air enters the mixing zone from the bottom at an oblique angle.

28. The device according to claim 20, wherein the at least one first supply line for humid air and/or the at least one supply line for cold air laterally enters the mixing zone and/or the growth zone.

29. The device according to claim 28, wherein the at least one first supply line for humid air and/or the at least one supply line for cold air enters the mixing zone and/or the growth zone in a substantially tangential direction, and wherein the mixing zone and/or the growth zone is conical in shape.

30. The device according to claim 20, wherein the release opening is a nozzle.

31. The device according to claim 30, wherein the nozzle is a Venturi nozzle.

32. The device according to claim 20, wherein entries of the at least one first supply line for humid air and the at least one second supply line for cold air into the mixing zone are positioned substantially next to each other, forming an angle of <180°.

33. The device according to claim 20, wherein entries of the at least one first supply line for humid air and the at least one second supply line for cold air into the mixing zone are positioned opposite each other, forming an angle of about 180°.

34. The device according to claim 20, wherein one of the at least one first supply line for humid air and the at least one second supply line for cold air is positioned within the other, optionally concentrically, such that the supply lines have a common entry point into the at least one substantially closed chamber.

35. The device according to claim 34, wherein the inner one of the two supply lines ends before the common entry point.

36. The device according to claim 20, wherein at least one part of the device, optionally at least one outer wall of the at least one substantially closed chamber and/or the at least one second supply line for cold air, is provided with a cooler and/or a heater.

37. The device according to claim 20, further comprising at least one heater for heating the humid air supplied thereto.

38. The device according to claim 20, wherein the device is transportable.

39. The device according to claim 20, wherein the at least one substantially closed chamber is at least partially made of a light-weight material selected from cloth, canvas, and plastic.

40. The device according to claim 20, wherein at least one substantially closed chamber is at least partially made of and/or lined with a material that inhibits growth of ice crystals.

* * * * *